US008061324B2

(12) United States Patent
Dauphin

(10) Patent No.: US 8,061,324 B2
(45) Date of Patent: Nov. 22, 2011

(54) HIGH PERFORMANCE RESIN PISTON INTERNAL COMBUSTION ENGINE

(75) Inventor: Michel Dauphin, Brighton (CA)

(73) Assignees: Murad Dharani, Markham (CA); Karim Dharani, Markham (CA)

( * ) Notice: Subject to any disclaimer, the term of this patent is extended or adjusted under 35 U.S.C. 154(b) by 391 days.

(21) Appl. No.: 12/416,173

(22) Filed: Apr. 1, 2009

(65) Prior Publication Data

US 2010/0251988 A1 Oct. 7, 2010

(51) Int. Cl.
*F02B 75/02* (2006.01)

(52) U.S. Cl. ..... 123/193.4; 123/193.6; 123/193.2

(58) Field of Classification Search .... 123/193.1–193.6, 123/195 R; 277/315; 92/225
See application file for complete search history.

(56) References Cited

U.S. PATENT DOCUMENTS

| | | | | |
|---|---|---|---|---|
| 1,728,514 | A | | 9/1929 | Snyder |
| 1,761,123 | A | | 6/1930 | Gruver |
| 2,884,290 | A | | 4/1959 | Morrow |
| 3,068,850 | A | | 12/1962 | Caddell |
| 3,327,593 | A | | 6/1967 | Ciaccia |
| 3,398,653 | A | | 8/1968 | Foster |
| 4,268,042 | A | * | 5/1981 | Borlan ..... 277/315 |
| 4,438,738 | A | | 3/1984 | Kosuda et al. |
| 4,440,069 | A | * | 4/1984 | Holtzberg et al. ..... 92/224 |
| 4,458,555 | A | | 7/1984 | Holtzberg et al. |
| 4,596,179 | A | | 6/1986 | Bando |
| 4,704,949 | A | | 11/1987 | Foster |
| 4,726,334 | A | * | 2/1988 | Holtzberg et al. ..... 123/195 R |
| 4,930,470 | A | | 6/1990 | Kabat et al. |
| 5,148,778 | A | * | 9/1992 | Klaue ..... 123/65 R |
| 5,375,569 | A | | 12/1994 | Santella |
| 5,724,860 | A | | 3/1998 | Sekiguchi et al. |
| 5,988,120 | A | | 11/1999 | Betsch et al. |
| 6,584,950 | B1 | | 7/2003 | Cunningham |
| 6,739,302 | B2 | | 5/2004 | Jones et al. |
| 7,284,526 | B2 | | 10/2007 | Williams |
| 2006/0169223 | A1 | | 8/2006 | Tabata et al. |
| 2007/0251483 | A1 | | 11/2007 | Jones et al. |
| 2008/0173273 | A1 | | 7/2008 | Cunningham |

* cited by examiner

*Primary Examiner* — M. McMahon
(74) *Attorney, Agent, or Firm* — Bernard P. Molldrem, Jr.

(57) ABSTRACT

A piston-type internal combustion engine is formed of a high performance synthetic resin material. The cylinders and pistons have an octagonal profile. Two or three rows of pin roller bearings are positioned in transverse semi-cylindrical grooves formed on the cylinder walls, to afford smooth, low-friction rolling contact and to seal the compression from leaking around the piston. There are angle support pieces fitted within the annular channels at respective vertices or corners, and are adapted for rotationally supporting the ends of adjacent pin roller bearings.

9 Claims, 4 Drawing Sheets

HIGH PERFORMANCE RESIN PISTON INTERNAL COMBUSTION ENGINE

BACKGROUND OF THE INVENTION

This invention relates to reciprocating internal combustion engines, such as diesel, gasoline or natural gas powered engines, and is more specifically directed to an internal combustion engine whose major parts, including cylinder block and pistons, are made of a high performance synthetic resin material.

An effort has been made to reduce the design weight of automotive engines, or other engines, and at the same time to increase efficiency and longevity. To this end, synthetic materials have been used in such engine parts as oil pans, valve covers, gear covers, cranks, and some internal parts such as rocker arms and connecting rods. One composite engine block, in which an outer shell is formed of a synthetic material, with cylinder sleeves formed of cast iron and with metal pistons, is described in U.S. Pat. Nos. 4,930,470. 4,440,069 discusses a composite piston for an internal combustion engine, in which the piston has a metal head or crown, and a skirt formed of a thermoplastic material, e.g., an amide-imide polymer with a high melting temperature. Polymer structures for use in internal combustion engines, such as for valve covers, composite connecting rods, and composite rocker arms, are discussed in the literature, e.g., U.S. Pats. Nos. 5,375,569; 4,726,334; and 4,438,738.

To date, even though durable synthetic materials are available, no one has previously proposed an internal combustion engine in which the components that constitute the combustion chamber itself, i.e., the piston and the cylinder walls, are formed of one of these high performance synthetic resin materials.

Several suitable high performance composite resins exist, which can withstand the extreme high temperatures and pressures of combustion of hydrocarbon fuels, and which have advantages of strength and light weight. These can include PEEK (polyether ether ketone), PTI (thermoplastic polyimide), PBI (polybenzimidazole), and PAI (polyamide-imide). However, with a traditional round-profile cylinder and piston construction, it is difficult to provide adequate lubrication and sealing.

Non-round profile piston/cylinder design in a reciprocating machine has been proposed for some applications. U.S. Pat. No. 1,761,123 describes a rectangular piston and rectangular cylinder, in which there is a cage of rollers in the space between the piston and cylinder, and the bearing cage is free to travel up and down during the piston stroke. This structure was proposed for use in a pump or compressor. However, to date, no one has proposed a polygonal profile design for a piston and cylinder in an internal combustion engine, nor associated with any device in which the piston and cylinder walls are formed of a synthetic or composite resin.

OBJECTS AND SUMMARY OF THE INVENTION

Accordingly, it is an object of this invention to provide a lightweight, durable, and efficient internal combustion engine, in which the pistons and engine block including cylinder walls, are formed of a high performance synthetic (composite) material, and which avoids the drawbacks of the prior art.

It is a more specific object to provide an internal combustion engine in which the block, pistons, and other engine components, including crank, connecting rods, and cylinder heads, for example, can all be made of high performance composite resin material.

It is another feature to provide bearings in the walls of the cylinder to allow the piston to glide smoothly up and down in its stroke, and also to prevent compression from escaping.

In accordance with an aspect of this invention, a piston-type internal combustion engine is formed of a high performance synthetic resin material. The engine block is formed of the high performance synthetic resin material, including the walls of the cylinder or cylinders. A crank is mounted in the engine block; and at least one piston that travels over a stroke distance in the cylinder or cylinders. For each said piston there is a connecting rod that has one end journalled in the associated piston and another end journalled on said crank.

The at least one piston is formed of the high performance synthetic resin material, and has a profile that is octagonal, or a regular polygon such as a hexagon. A carbon fiber filler can be incorporated for added strength. The at least one cylinder in the engine block has a profile that is in the form of an octagon (or other regular polygon) to match the profile of the associated piston. The cylinder is formed of a plurality (e.g., eight) of flat vertical wall sections, each formed of the high performance synthetic resin material. These eight wall sections then each meet adjacent wall sections at corners (or vertices) of the octagon.

Transverse semi-cylindrical grooves are formed on the cylinder walls at respective axial levels on the wall sections, such that the grooves at each said level combine to form a polygonal (i.e., eight sided) annular channel, with each of these having an open side facing towards the associated piston. Preferably there are two annular channels at two levels, or three at three levels. Roller bearings are positioned in these transverse grooves, and these bear against the sides of the associated piston, to afford smooth, low-friction rolling contact and to seal the compression from leaking around the piston.

There are angle support pieces fitted within the polygonal annular channels at respective vertices or corners, and these are adapted for rotationally supporting the ends of adjacent ones of the roller bearings. The support pieces also fill the generally triangular space defined between the adjacent ends the successive roller bearings. In this structure, the bearings are disposed in annular rows of bearings at each of the two or three levels in the cylinder walls.

Preferably, the roller bearings also are formed of a high performance synthetic resin, although in some preferred embodiments, steel roller bearings are employed.

In a preferred embodiment, the roller bearings each have a pivot pin projecting axially from each end, such that the pivot pin at each end is journalled in one of said angle support pieces. The angle support pieces can be constructed to have a pair of flat faces at angles to one another, and each of which has a bore in which a respective pivot pin is journalled.

The roller bearings can be permanently lubricated with a silicone grease.

The number and the locations of the rows of bearings depends on the stroke length of the pistons. Preferably, the two rows of bearings are disposed at an upper half of the cylinder.

The position of the water cooling jacket within the block can be molded or formed at an optimum location near the upper parts of the cylinders. Additives or fillers can be present in the resin to increase thermal conductivity at the cylinder walls.

The above and many other objects, features, and advantages of this invention will become apparent to persons skilled in the art from the ensuing description of a preferred embodiment, which is to be read in conjunction with the accompanying Drawing.

DETAILED DESCRIPTION OF THE PREFERRED EMBODIMENT(S)

Figure 1:
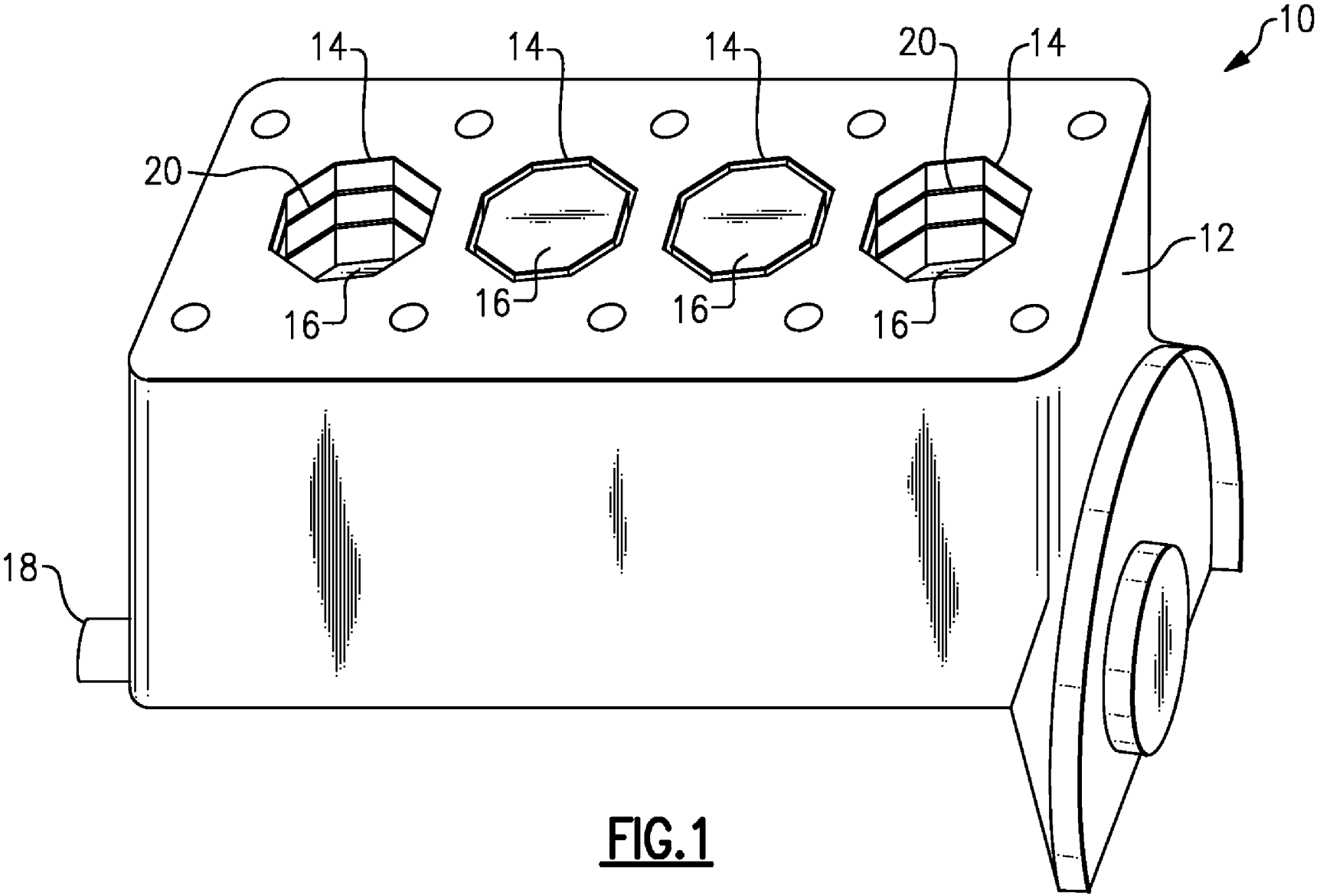
FIG. 1 is a perspective assembly view of an engine block with pistons, according to one possible embodiment of this invention.

With reference to the Drawing, and initially to FIG. 1, an embodiment of the invention is an internal combustion engine 10 constructed of a high performance composite resin. FIG. 1 shows an engine block 12 (with portions such as head, oil pan, gear covers etc omitted in this view), with a number of octagonal cylinders 12, each of which houses a reciprocating piston 14, of a mating octagonal profile. A crank 18 is housed in the engine block 12. There are threaded holes shown here for mounting the cylinder head. Not shown here are cavities molded within the block for the circulation of an engine coolant. In this view, the number two and three cylinders are shown with their pistons 16 at top dead center, and the number one and four cylinders with their pistons 16 at bottom dead center. Within the latter cylinders can be seen transverse roller pin bearings 20 placed at two levels along the upper part of the flat cylinder wall portions of each octagonal cylinder. These will be described in more detail shortly.

Figure 2:
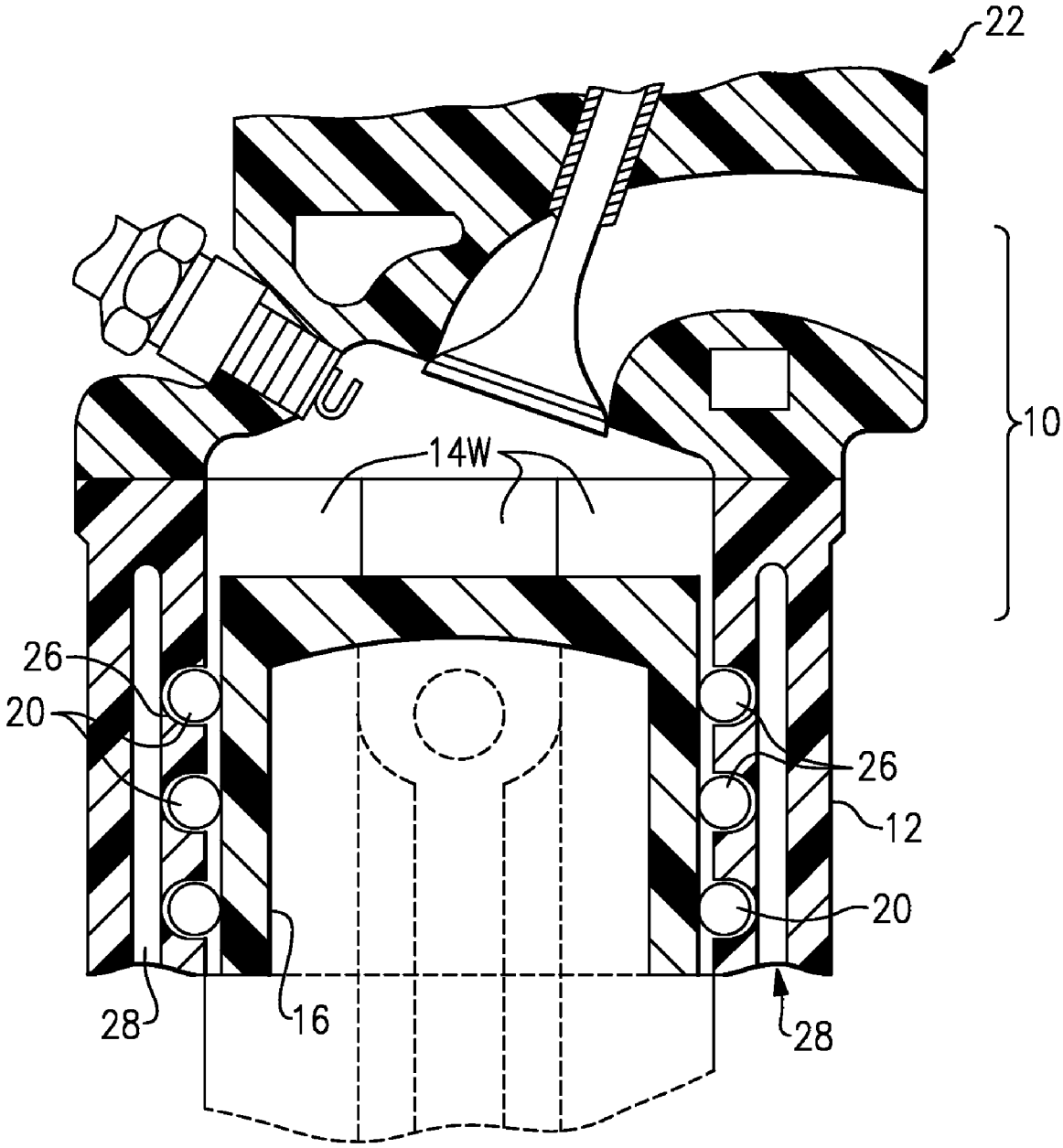
FIG. 2 is cross section of the engine of this embodiment.

FIG. 2 is a section of the internal combustion engine 10 across one cylinder, showing the arrangement of the cylinder 14 and associated piston 16. Here, the cylinder head 22 is shown mounted atop the engine block 10. The head 22 is also formed of the light-weight high-performance composite material, and has the usual component, including valves and a spark plug or igniter. The piston 16, head 22 and eight walls segments 14W of the cylinder 14 together define a combustion chamber in which the intake mixture is compressed and in which the hot combustion gases expand to drive the piston 16 downward. Here, a connecting rod 24 (also constructed of a synthetic composite material) has an upper end that is journalled to the piston 16. A lower end of the connecting rod 24 is journalled to the crank 18.

The pin bearings 20 are shown here positioned in semicylindrical grooves 26 formed transversely along the wall segments 14W of the cylinder. These permit a portion of each of the bearings 20 to extend radially into the cylinder and contact a corresponding wall of the octagonal piston 16. In this case, there are three rows of rollers or bearings 20. Preferably, the number of rows of bearings, and their axial positions will depend on the stroke length of the piston (between TDC and BDC).

A water jacket 28, i.e., cavities for flow of coolant, maybe formed in the engine block 12 beyond the walls of the cylinders.

Figure 3:
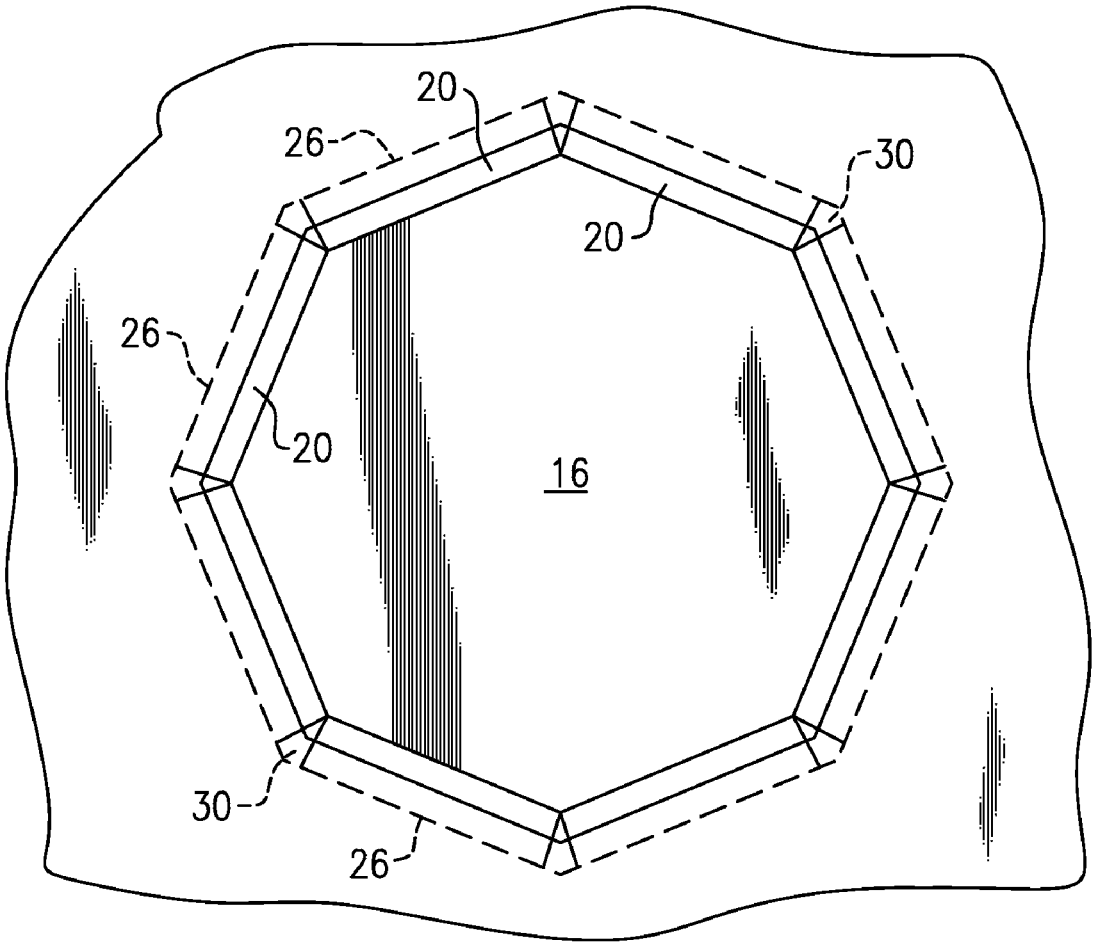
FIG. 3 is a top or axial end view showing a piston and a cylinder of the engine of this embodiment, with some details shown in ghost or broken line.
Figure 4:
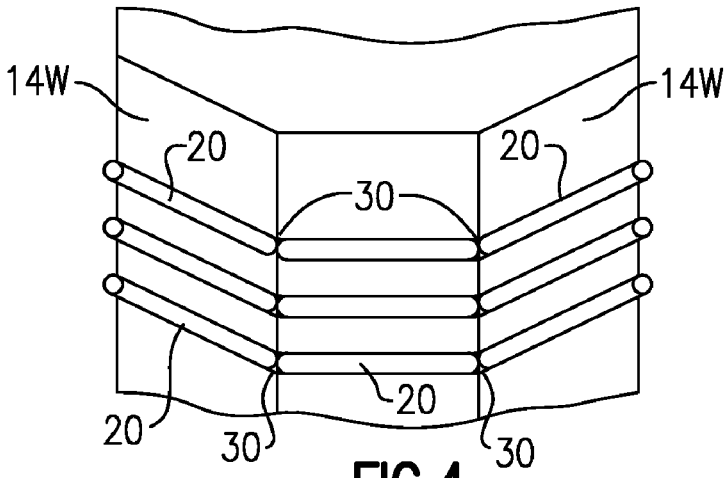
FIG. 4 is a partial cutaway of the cylinder, showing bearings positioned at axial or vertical locations along the cylinder wall.

The bearings 20 and recesses 26 at each level are arranged end-to-end, to form an octagonal ring or closed-loop row of bearings, as shown in the top plan view of FIG. 3. These are also shown in the partial perspective view of FIG. 4. At the end of each bearing, where successive bearings meet at a corner or angle formed by adjacent wall segments 14W, is a corner bearing piece 30. The corner piece 30 are seated into the transverse groove or recess 26 at the corners. These elements rotationally support the ends of the two adjacent pin bearings 20, and also block off the generally triangular space that would remain between the end faces of the two bearings, and prevent escape of the combustion gases during compression and power phases. The rings of bearings 20 and corner pieces 30 serve the purpose of the conventional non-rotating piston rings of the conventional reciprocating piston engine, but with much lower frictional losses.

Figure 5:
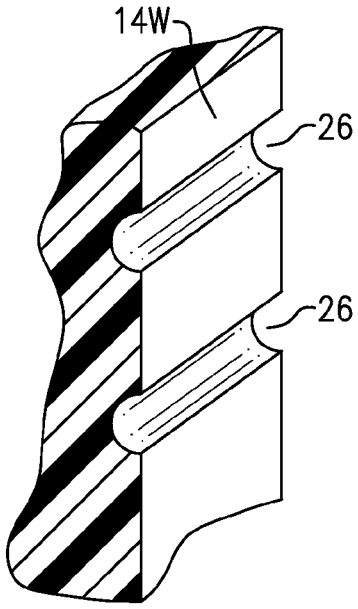
FIG. 5 is a cross section of a cylinder wall portion, showing semicylindrical grooves or channels for the pin roller bearings.
Figure 6:
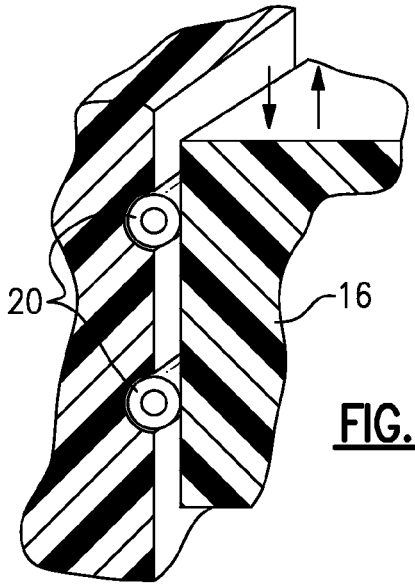
FIG. 6 is a cross sectional view showing action of the piston and pin bearings.

FIGS. 5 and 6 show more detail of the semicylindrical recesses 26 formed in each of the wall segments 14W or the cylinder (FIG. 5), and show the supporting relation of the pin bearings 20 in respect to the associated polygon-profile piston 16.

Figure 7:
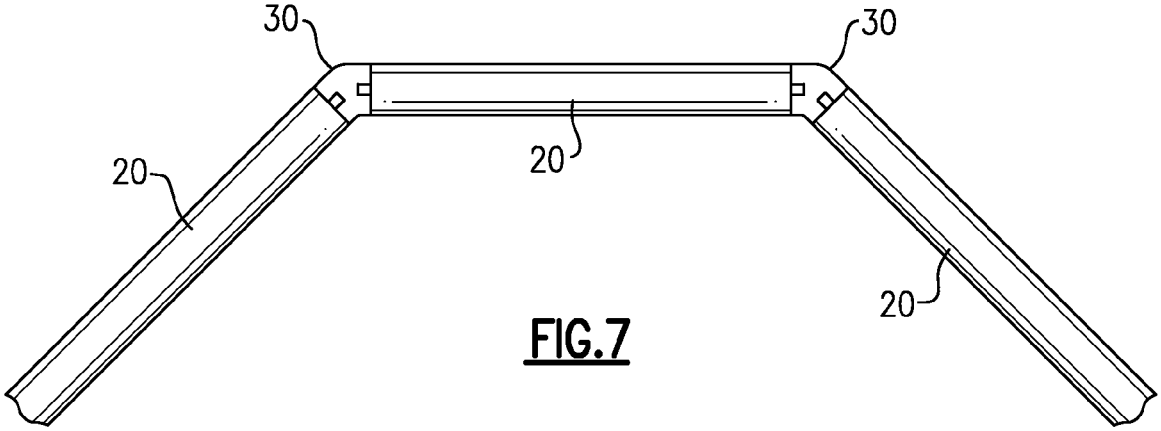
FIG. 7 illustrates a series of the pin bearings joined by angle pieces.
Figure 8:
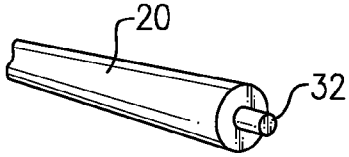
FIG. 8 is a perspective of one end of a pin bearing.
Figure 9:
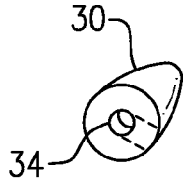
FIG. 9 is a perspective of an angle support piece.

The relation of the bearing pins 20 and the associated corner bearing pieces 30 is shown in FIGS. 7,8, and 9. Each pin roller 20 has a pivot pin 32 that protrudes axially from each end face (FIG. 8). The corner pieces 30 are wedge shaped to match the angles made by the end faces of the two adjacent roller pins, as shown in FIG. 7, and in the case of the octagonal piston and cylinder construction, the corner pieces have a wedge angle of forty-five degrees. The wedge piece 30 (FIG. 9) has two round faces, these having a pivot receptacles 34 into which pivot pins 32 of the associated rollers 20 are received. There may be open slots at the positions of the dash lines in FIG. 9, aligned with the receptacles 34 to allow the rollers 20 to be pushed into place.

The entire internal combustion engine 10 can be made of composite materials such as PEEK or other high performance composite resins. The engine is suitable for gas or diesel, and with its lightweight construction this engine design is ideal for a natural gas powered engine. This engine design is also ideal for small engine applications, e.g., lawn mower or chain saw.

In the foregoing embodiment, the shape of the cylinder is octagonal inside and has two (or three) octagonal grooves or recesses formed at the upper part of the cylinder, i.e., near the cylinder head. Silicone grease may be used for permanent lubrication of the bearings 20. The two (or three) octagonal annular rows of bearings guide the piston such that there is little loss of compression, and the small amount of compression loss that may be present is more than compensated by the absence of friction between piston and cylinder.

While this embodiment has eight-sided pistons and cylinders, these members could have other polygonal profiles, e.g., hexagonal. Also, while this embodiment shows a standard four-cycle design, a two-cycle or two-stroke engine is also possible. The illustrated engine has four cylinders, but this invention would apply to engines of one, two, six, or eight cylinders, for example.

Many other modifications and variations are possible which would not depart from the scope and spirit of this invention, as defined in the appended claims.

I claim:

1. A piston internal combustion engine formed of a high performance synthetic resin material, comprising:

an engine block formed of said synthetic resin material and having at least once cylinder therein; a crank mounted in the engine block; and at least one piston that travels over a stroke distance in said at least one cylinder; and for each said piston a connecting rod that has one end journalled in the associated piston and another end journalled on said crank; wherein said at least one piston is formed of said high performance synthetic resin material, and has a profile that is a regular polygon;

said at least one cylinder has a profile that is in the form of said regular polygon to match the profile of the associated piston; and is formed of a plurality of flat vertical walls, of said high performance synthetic resin material, which each meet adjacent ones of said walls at corners thereof;

said cylinder walls having a plurality of transverse semi-cylindrical grooves therein at respective axial levels on said side walls, such that the grooves at each said level combine to form a polygonal annular channel having an open side thereof facing towards the associated piston;

a plurality of roller bearings positioned in said transverse grooves, such that said roller bearings each bear against a flat side of the associated piston; and a plurality of angle support pieces fitted within the polygonal annular channels at respective ones of said corners, adapted for rotationally supporting the ends of adjacent ones of said roller bearings and also filling a triangular space defined between the adjacent ends of successive ones of said roller bearings, such that said bearings are disposed in annular rows of bearings at each said level in the cylinder walls.

2. The piston internal combustion engine according to claim 1 wherein said piston and said cylinder have a regular octagonal profile.

3. The piston internal combustion engine according to claim 1 wherein said roller bearings are formed of a high performance synthetic resin.

4. The piston internal combustion engine according to claim 3 wherein said roller bearings each have a pivot pin projecting axially from each end thereof, the pivot pin being journalled in one of said angle support pieces.

5. The piston internal combustion engine according to claim 4 wherein each of said angle support pieces have a pair of flat faces each of which has a bore in which a respective one of said pivot pins is journalled.

6. The piston internal combustion engine according to claim 1 wherein cylinder walls each have two and only two grooves therein and two and only two annular rows of said roller bearings.

7. The piston internal combustion engine according to claim 1 wherein cylinder walls each have three and only three grooves therein and three and only three annular rows of said roller bearings.

8. The piston internal combustion engine according to claim 1 wherein said roller bearings are permanently lubricated with a silicone grease.

9. The piston internal combustion engine according to claim 1 wherein said grooves and said bearings are disposed at an upper half of the associated cylinder.

* * * * *